United States Patent [19]

Hirsh

[11] 4,020,675

[45] May 3, 1977

[54] MANUFACTURE OF CIGARETTES

[75] Inventor: Ivan Y. Hirsh, London, England

[73] Assignee: Molins Limited, England

[22] Filed: Jan. 13, 1975

[21] Appl. No.: 540,345

[30] Foreign Application Priority Data

Jan. 18, 1974 United Kingdom ..... 2592/74

[52] U.S. Cl. ..... 73/41

[51] Int. Cl.[2] ..... G01M 3/26

[58] Field of Search ..... 73/41, 45.1, 45.2; 198/20 C, 103

[56] References Cited

UNITED STATES PATENTS

| | | | |
|---|---|---|---|
| 3,395,570 | 8/1968 | Kochalski | 73/45.2 |
| 3,408,858 | 11/1968 | Kaeding et al. | 73/45.2 |
| 3,612,252 | 10/1971 | Yu | 198/103 |
| 3,677,068 | 7/1972 | Schmermund | 73/41 |
| 3,757,564 | 9/1973 | Blackburn et al. | 73/45.1 |
| 3,760,631 | 9/1973 | Doerman | 73/45.1 |
| 3,769,832 | 11/1973 | Baier | 73/41 |
| 3,913,381 | 10/1975 | Heitmann | 73/45.1 |
| 3,943,752 | 3/1976 | Doerman et al. | 73/41 |
| R27,277 | 1/1972 | Williamson | 73/41 X |

FOREIGN PATENTS OR APPLICATIONS

| | | | |
|---|---|---|---|
| 1,189,020 | 4/1970 | United Kingdom | 73/45.1 |

*Primary Examiner*—Richard C. Queisser
*Assistant Examiner*—John S. Appleman
*Attorney, Agent, or Firm*—Craig & Antonelli

[57] ABSTRACT

A testing device for filter-tipped cigarettes comprises a first source of positive or negative pressure arranged to be connected to at least one end of each cigarette to be tested, to produce an air flow through the wrapper of the cigarette, means for monitoring the pressure or flow rate of the air flow to detect the presence of an excessively leaky wrapping, and means for defining a chamber around the cigarette in the region of the joint between the filter and the tobacco-filled part of the cigarette and for connecting the chamber to a second source of negative or positive pressure.

11 Claims, 3 Drawing Figures

MANUFACTURE OF CIGARETTES

This invention is concerned with testing cigarettes for leaks in the wrappers. More specifically, this invention is concerned with testing filter-tipped cigarettes. In this context the term "filter" is intended to cover any form of mouthpiece which may be attached to the tobacco-filled portion of the cigarette.

According to the present invention a cigarette testing device for filter-tipped cigarettes comprises a first source of positive or negative pressure arranged to be connected to at least one end of each cigarette to be tested, to produce an air flow through the wrapper of the cigarette, means for monitoring the pressure or flow rate of the air flow to detect the presence of an excessively leaky wrapping, and means for defining a chamber around the cigarette in the region of the joint between the filter and the tobacco-filled part of the cigarette and for connecting the chamber to a second source of negative or positive pressure. In other words, the first and second sources are of opposite senses, one being positive (i.e., above atmospheric) and the other negative (i.e., below atmospheric) or vice versa.

The provision of the chamber with air at a pressure of opposite sense to that provided by the first source increases the air flow in the event of a leak in the joint between the filter and the remainder of the cigarette. Therefore the testing device is especially sensitive to leaks in the joint.

Examples of testing devices according to this invention are shown in the accompanying drawings. In these drawings.

Figure 1:
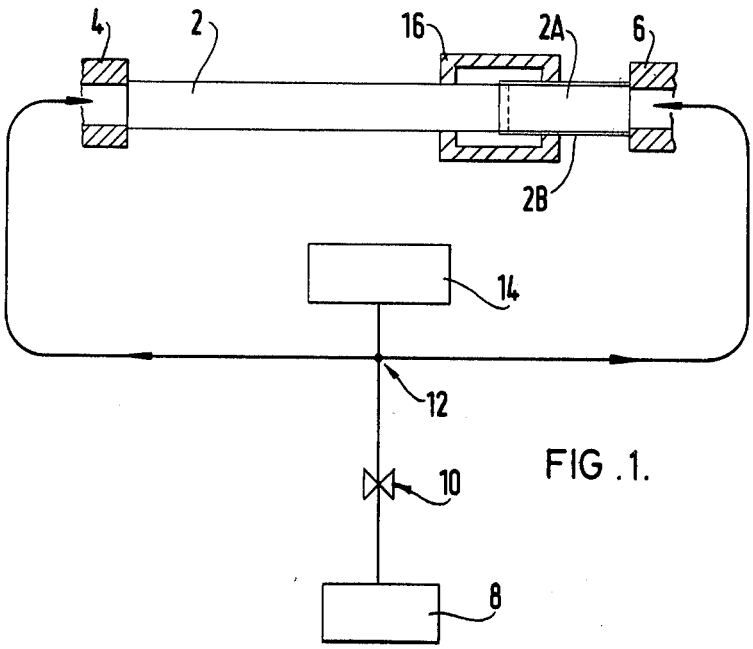
FIG. 1 is a diagrammatic view of one testing device.

As shown in FIG. 1, a cigarette 2 including a filter 2A has air at above atmospheric pressure blown into both ends via connector pieces 4 and 6 abutting the ends of the cigarette. This air is delivered to the connector pieces from a source 8 of positive pressure air, and flows to the connector pieces 4 and 6 via a restrictor 10 and a junction 12. A pressure monitoring transducer 14 is also connected to the junction 12.

Around the region of the joint between the filter 2A and the remainder of the cigarette there is a suction chamber 16, suction being supplied to the interior of the chamber by any convenient means.

The pressure sensed at the junction 12 by the transducer 14 depends upon the leakiness of the cigarette wrapper. A leak in the wrapper increases the air flow through the restrictor 10, thus increasing the pressure drop through the restrictor and reducing the pressure at the junction 12. In view of the suction in the chamber 16, a leak in the joint produces an especially significant increase in the air flow from the source 8. In other words, a leakage passage of given cross-section in the joint produces a larger increase in the air flow than is produced by a similar leakage passage elsewhere along the cigarette.

It will be understood that leaks in the joint, which the testing device of the present invention is particularly designed to detect, occur mainly as a result of imperfect adhesion between the end of the tobacco-filled portion of the cigarette and the part of the connecting web 2B which overlaps the end portion to join the filter 2A to the tobacco-filled portion.

Instead of the source 8 being a positive pressure source, it may be a negative pressure source (i.e., suction), in which case the chamber 16 is supplied with above-atmospheric pressure. In this case the connector piece 4 may be replaced by a closure member which closes the adjacent end of the cigarette, suction being transmitted only to the filter end of the cigarette via the connector piece 6.

Figure 3:
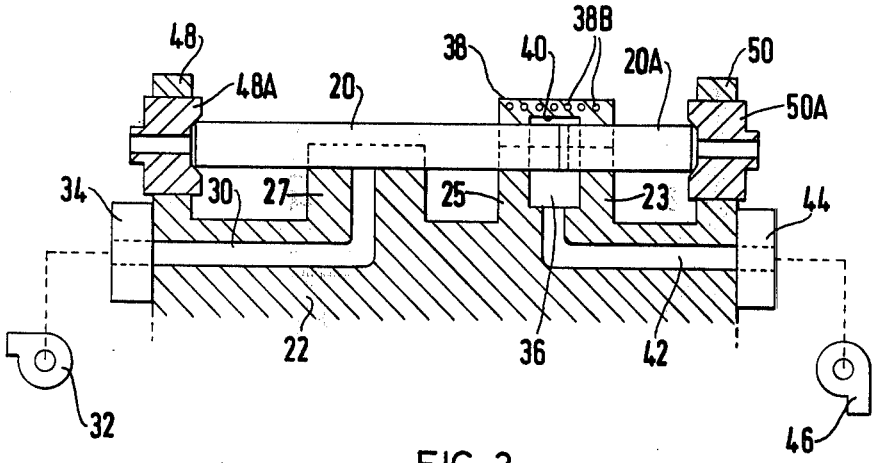
FIG. 3 is a section on the line III—III in FIG. 2.
Figure 2:
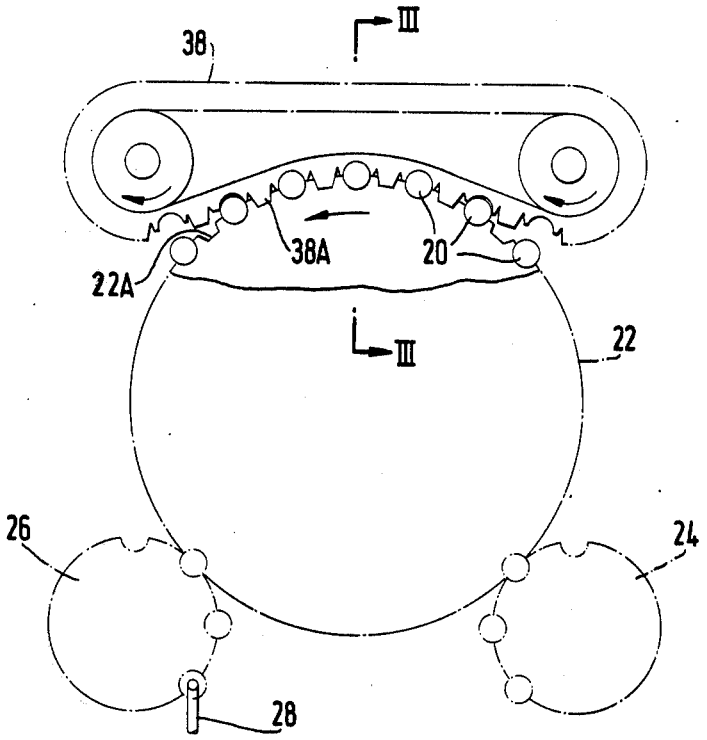
FIG. 2 is a side elevation showing, in more detail, a different testing device which is basically like that shown in FIG. 1.

FIGS. 2 and 3 show, in more detail, a testing device which is basically similar to that shown in FIG. 1.

As shown in FIG. 2, cigarettes 20 are carried during testing by a fluted drum 22. This drum receives cigarettes from a transfer roller 24 and delivers them, after testing, to a transfer roller 26. Any cigarettes which are found to be faulty are ejected by being blown axially off the transfer roller 26 by an air jet directed endwise onto the cigarette from a pipe 28.

Each cigarette 20 includes a filter portion 20A which is joined to the tobacco-filled part of the cigarette by means of a connecting web in the manner described above. The cigarette is supported in flutes of semi-cylindrical shape formed in flanges 23, 25 and 27 on the drum 22. Suction is applied to a passage 30 from a source 32 via a stationary pad 34 bearing against one end of the drum; each passage 30 opens out in one of the flutes formed in the flange 27 to hold the cigarette on the drum by means of suction (except possibly during testing).

The flanges 23 and 25 partly define a chamber 36 which is completed by a moulded endless belt 38 which is pressed against the flanges 23 and 25 and is formed with semi-cylindrical recesses fitting closely around the cigarette so as substantially to seal the chamber 36 from the atmosphere. In the region of each cigarette the band 38 is formed with a recess 40 which forms the upper part of the chamber 36. Suction is supplied to the chamber 36, during testing, via a passage 42 in the drum which communicates with a stationary pad 44 bearing against one end of the drum, the pad being connected to a suction fan 46.

The band 38 is formed at regular intervals (between the portions engaging the cigarettes) with driving teeth 38A engaging in correspondng recesses 22A in the drum so that the band is driven by the drum at a speed equal to the peripheral speed of the drum. The band includes longitudinal reinforcing strands 38B which may for example be of metal wire.

At opposite ends of the drum 22 there are flanges 48 and 50 which carry axially movable connector pieces 48A and 50A which are arranged to be moved axially into engagement with the ends of the cigarettes. A source of positive pressure is connected to both connector pieces during testing as described with reference to FIG. 1.

The connector pieces 48A and 50A are moved axially away from the cigarettes, for example by means of cams or any other known arrangement, to enable the cigarettes to be transferred to and from the drum 22. In other words, in the region of the transfer drum 24 the connector pieces are at outer positions to enable the cigarettes to be transferred to the drum 22; then, as the drum 22 rotates, the connector pieces are moved axially into engagement with the ends of the cigarettes to be ready for testing of the cigarettes, and then after testing the connector pieces are moved away from the cigarettes to allow the cigarettes to be transferred to the drum 26. An example of an arrangement for moving such connector pieces is shown in U.S. Pat. No. 3,408,858.

I claim:

1. A testing device for filter-tipped cigarettes comprising a first source of pressure different from atmospheric pressure arranged to be connected to at least one end of each cigarette to be tested, to produce an air flow through the wrapper of the cigarette, means for monitoring the air flow to detect the presence of an excessively leaky wrapping, means for defining a chamber around the cigarette solely in the region of the joint between the filter and the tobacco-filled part of the cigarette including sealing means movable with the cigarettes during testing for substantially sealing the ends of the said chamber around the cigarettes and means for connecting the chamber to a second source of pressure of opposite sense with respect to said first source.

2. A testing device according to claim 1 in which the first source is a positive pressure source, the second source being a negative pressure source.

3. A testing device according to claim 1 in which the first source is connected to at least one end of each cigarette via a restrictor and via a junction to which a transducer is connected to detect the pressure at the junction.

4. A testing device according to claim 1 including a drum arranged to carry the cigarettes sideways during testing, said chamber being formed around each cigarette in turn between a part of the drum and said sealing means in the form of a second conveyor member.

5. A testing device according to claim 4 in which the second conveyor member is an endless band which passes around part of the periphery of the drum to form with the drum a chamber around each cigarette for a predetermined period of time.

6. A testing device according to claim 5 in which the endless band comprises a molding of flexible material.

7. A testing device according to claim 6 in which the molding of flexible material includes one or more longitudinally extending reinforcing strands.

8. A testing device according to claim 6 in which the endless band has driving teeth which engage recesses in the drum whereby the band is driven by the drum at a speed equal to the peripheral speed of the drum.

9. A testing device for filter-tipped cigarettes as defined in claim 1 wherein said sealing means comprises a first row of concave sealing parts movable along a path lying on the filter side of the joint of each cigarette, a second row of concave sealing parts movable along a path lying near the joint on the side of the joint opposite to said first row of sealing parts, and means bridging said first and second rows of sealing parts.

10. A testing device for filter-tipped cigarettes as defined in claim 9 includng a drum arranged to carry the cigarettes sideways during testing, and in which each row of sealing parts comprises an integral band member having integral teeth to engage in recesses in the drum whereby the band member is driven positively by the drum in timed relation with the cigarettes on the drum.

11. A testing device for filter-tipped cigarettes as defined in claim 10 in which said first and second rows of sealing parts and said bridging means are integral parts of an endless band which passes around part of the periphery of the drum to form with the drum a chamber around each cigarette for a predetermined period of time.

* * * * *